US010215358B2

(12) United States Patent
Han et al.

(10) Patent No.: US 10,215,358 B2
(45) Date of Patent: Feb. 26, 2019

(54) LOW BEAM SHIELD FOR HEADLAMPS

(71) Applicant: SL Corporation, Daegu (KR)

(72) Inventors: Hyo Jin Han, Gyeonsangbuk-Do (KR); Jin Young Jung, Gyeonsangbuk-Do (KR)

(73) Assignee: SL Corporation, Daegu (KR)

( * ) Notice: Subject to any disclaimer, the term of this patent is extended or adjusted under 35 U.S.C. 154(b) by 88 days.

(21) Appl. No.: 14/957,857

(22) Filed: Dec. 3, 2015

(65) Prior Publication Data

US 2016/0186954 A1 Jun. 30, 2016

(30) Foreign Application Priority Data

Dec. 24, 2014 (KR) ..... 10-2014-0188598

(51) Int. Cl.

| | |
|---|---|
| ***F21V 11/00*** | (2015.01) |
| ***F21S 41/00*** | (2018.01) |
| ***F21S 41/43*** | (2018.01) |
| ***F21S 41/36*** | (2018.01) |
| *F21S 41/147* | (2018.01) |
| *F21S 41/255* | (2018.01) |
| *F21S 41/365* | (2018.01) |

(52) U.S. Cl.
CPC ..... *F21S 41/43* (2018.01); *F21S 41/36* (2018.01); *F21S 41/147* (2018.01); *F21S 41/255* (2018.01); *F21S 41/365* (2018.01)

(58) Field of Classification Search
CPC ..... F21S 48/145; F21S 48/1388
USPC ..... 362/303, 509
See application file for complete search history.

(56) References Cited

U.S. PATENT DOCUMENTS

| | | | | |
|---|---|---|---|---|
| 2007/0247864 | A1* | 10/2007 | Suzuki | F21S 48/145 362/538 |
| 2010/0309678 | A1* | 12/2010 | Yamagata | F21S 48/1159 362/539 |
| 2010/0309679 | A1* | 12/2010 | Yamagata | F21S 48/1159 362/539 |
| 2013/0051054 | A1* | 2/2013 | Yamagata | F21S 48/145 362/518 |
| 2015/0159826 | A1* | 6/2015 | Sekiguchi | F21S 48/1104 362/517 |

* cited by examiner

*Primary Examiner* — Jong-Suk (James) Lee
*Assistant Examiner* — Eric T Eide
(74) *Attorney, Agent, or Firm* — Mintz Levin Cohn Ferris Glovsky and Popeo, P.C.; Kongsik Kim; Jhongwoo Jay Peck

(57) ABSTRACT

A low beam shield for headlamps forms a low beam pattern having a uniform light distribution. The low beam shield for headlamps is installed within a headlamp of a vehicle and forms a low beam pattern irradiated ahead of the vehicle and includes a back plate that forms a horizontal plane, a first front plate that extends from a first side of a front end of the back plate and forms a first cut-off edge and a second front plate that extends from a second side of the front end of the back plate and forms a second cut-off edge. An upper surface of the first front plate having the first cut-off edge has a different slope than an upper surface of the second front plate having the second cut-off edge.

17 Claims, 12 Drawing Sheets

LOW BEAM SHIELD FOR HEADLAMPS

CROSS-REFERENCE TO RELATED APPLICATIONS

This application claims priority from Korean Patent Application No. 10-2014-0188598 filed on Dec. 24, 2014 in the Korean Intellectual Property Office, the disclosure of which is incorporated herein by reference in its entirety.

Technical Field

The present invention relates to a low beam shield for headlamps, and more particularly, to a shield which forms a low beam pattern irradiated ahead of a vehicle.

Related Art

Generally, a vehicle includes various types of vehicle lamps that have a lighting (e.g., an illumination) function and a signaling function. The lighting function enables the driver of the vehicle to detect objects proximate to the vehicle while driving during low light conditions (e.g., at night). The signaling function is used to inform other vehicles and road users of the vehicle's driving state. For example, a low beam/high beam headlamp and a fog lamp are mainly designed for the lighting function, and a turn signal lamp (e.g., signal lamp), a tail lamp, a brake lamp, and a position lamp are mainly designed for the signaling function.

The luminous intensity, color of light, light distribution range, etc. for these vehicle lamps are regulated by statute. For example, a low beam emitted from a low beam lamp is restricted from exceeding a certain cut-off line in order to protect the vision of the driver of an oncoming vehicle or a preceding vehicle. Typically, a low beam lamp includes a reflector having a reflective surface that reflects the light emitted from a light source toward a lens and a shield that forms a cut-off line that partially obstructs (e.g., blocking) the light that travels from the reflector toward the lens.

FIG. 18 is an exemplary perspective view of a conventional shield 1. FIG. 19 is an exemplary illustration of a low beam pattern $A_1$ formed by a low beam irradiated by the conventional shield 1 onto a screen. For example, the closed loops illustrated in FIG. 19 are lines that connect points having approximately the same luminous intensity in the low beam pattern $A_1$ formed on the screen. The luminous intensity gradually increases from the exterior toward the interior. Referring to FIG. 19, the low beam pattern A1 forms a certain cut-off line C.

In particular, referring to FIG. 18, the conventional shield 1 includes first through third successive plates 12 through 14 that obstruct light emitted from a light source, and a cut-off edge 11 that corresponds to the cut-off line C of the low beam pattern $A_1$ is formed at front ends of the first through third plates 12 through 14. For example, in an area where vehicles drive on the right side of the road, there are no oncoming vehicles on the right side. Therefore, a low beam having the cut-off line C whose right side is located higher than a left side as illustrated in FIG. 19 may be used to widen an irradiation range on the right side ahead of a vehicle.

Further, to form the cut-off line C, referring to FIG. 18, the cut-off edge 11 consists of a first cut-off edge 11*a* and a second cut-off edge 11*c* which form a step there between and a third cut-off edge 11*b* which forms a slope and connects the first cut-off edge 11*a* and the second cut-off edge 11*c*. Due to the cut-off edge 11 shaped as described above, the first plate 12 having the first cut-off edge 11*a* and the second plate 14 having the second cut-off edge 11*c* also form a step there between, and the third plate 13 having the third cut-off edge 11*b* is formed as an inclined plane which connects the first plate 12 and the second plate 14.

To prevent the reduction of light obstructed by the first through third plates 12 through 14, upper surfaces of the first through third plates 12 through 13 are coated with a reflective material. Therefore, light reflected off the upper surfaces of the first through third plates 12 through 14 is reflected by a reflector to form the low beam pattern $A_1$. However, since a step is formed between the first plate 12 and the second plate 14, a region of the low beam pattern $A_1$ is distorted as shown in the B region of FIG. 19. The distorted region such as the B region of FIG. 19 has non-uniform intensity of illumination and luminance, thereby causing visual fatigue to a driver.

The above information disclosed in this section is merely for enhancement of understanding of the background of the invention and therefore it may contain information that does not form the prior art that is already known in this country to a person of ordinary skill in the art.

SUMMARY

The present invention provides a low beam shield for headlamps, the low beam shield capable of forming a low beam pattern having a uniform light distribution.

In one aspect of the an exemplary embodiment provides, a low beam shield for headlamps that may be installed within a headlamp of a vehicle and may form a low beam pattern irradiated ahead of the vehicle. The low beam shield may include a back plate that forms a horizontal plane, a first front plate that extends from a first side of a front end of the back plate and forms a first cut-off edge and a second front plate that extends from a second side of the front end of the back plate and forms a second cut-off edge. An upper surface of the first front plate having the first cut-off edge may have a different slope from an upper surface of the second front plate having the second cut-off edge.

According to another exemplary embodiment, a low beam shield for headlamps may be indisposed within a headlamp of a vehicle and may form a low beam pattern irradiated to ahead of the vehicle. The low beam shield may include a back plate, a first front plate that extends from a first side of a front end of the back plate and forms a first cut-off edge and a second front plate that extends from a second side of the front end of the back plate and forms a second cut-off edge. An upper surface of the first front plate having the first cut-off edge may slope downward toward a first side of the back plate.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
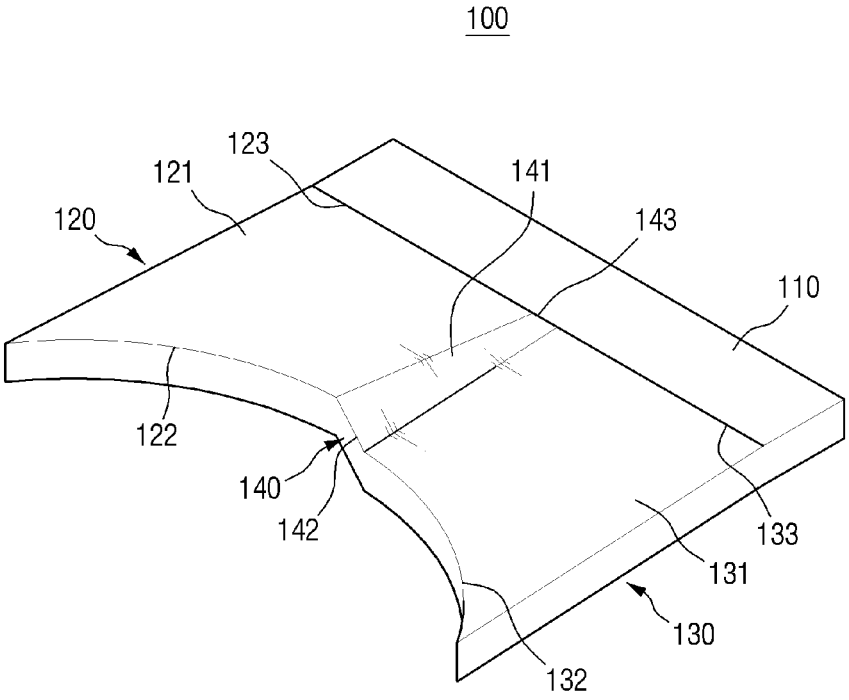
FIG. 1 is an exemplary perspective view of a low beam shield according to an exemplary embodiment of the present invention.

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

Embodiments of the invention are described herein with reference to cross-section and/or schematic illustrations that are illustrations of idealized embodiments of the invention. As such, variations from the shapes of the illustrations as a result, for example, of manufacturing techniques and/or tolerances, are to be expected. In addition, each component shown in figures of the present invention may have been enlarged or reduced for ease of description. Like numbers refer to like elements throughout.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.01%, 0.05%, or 0.01% of the stated value. Unless otherwise clear from the context, all numerical values provided herein are modified by the term "about."

Hereinafter, the present invention will be described more fully with reference to the accompanying drawings, in which exemplary embodiments of the invention are shown.

Figure 2:
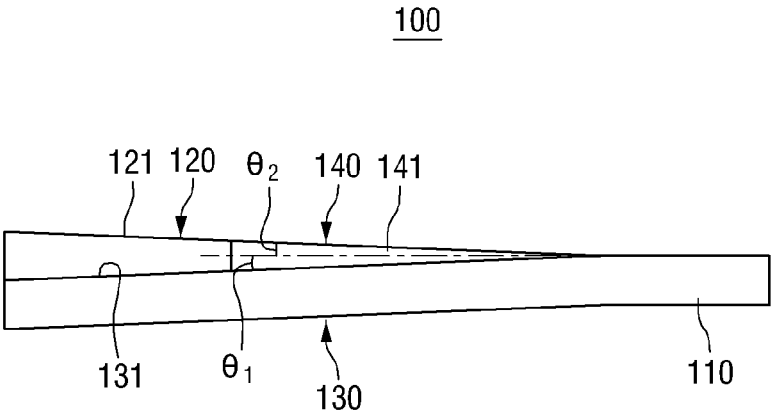
FIG. 2 is an exemplary side view of the low beam shield of FIG. 1 according to an exemplary embodiment of the present invention.

FIG. 1 is an exemplary perspective view of a low beam shield 100 according to an exemplary embodiment of the present invention. FIG. 2 is an exemplary side view of the low beam shield 100 of FIG. 1. Referring to FIG. 1, the low beam shield 100 according to an exemplary embodiment of the present invention may include a back plate 110, a first front plate 120, a second front plate 130, and a third front plate 140. As illustrated in FIG. 1, the back plate 110 may form the base of the first front plate 120, the second front plate 130 and the third front plate 140 and may include an upper surface that forms a horizontal plane that extends from the rear of the first front plate 120 to the rear of the second front plate 130. As illustrated in FIG. 1, a front end (e.g., a boundary between the back plate 110 and the first through third front plates 120 through 140) of the back plate 110 may form a straight line, and the upper surface of the back plate 110 may be rectangular. The first front plate 120 may extend forward from a first side of the front end of the back plate 110. A first cut-off edge 122 may be convex rearward formed at a front end of the first front plate 120. The first cut-off edge 122 may form a first or second side of a cut-off line C (see FIG. 6) of a low beam pattern $A_2$ (see FIG. 6) formed by the low beam shield 100.

As illustrated in FIG. 2, an upper surface 121 of the first front plate 120 having the first cut-off edge 122 may form a positive slope $\theta_2$ with respect to the upper surface of the back plate 110 and may form an upwardly inclined plane. Referring to FIGS. 1 and 2, a rear end 123 of the upper surface 121 of the first front plate 120 may form the same plane with the upper surface of the back plate 110. The second front plate 130 may extend forward from a second side of the front end of the back plate 110. A second cut-off edge 132 may have a convex rearward geometry and may be formed at a front end of the second front plate 130. The second cut-off edge 132 may form the second or first side of the cut-off line C (see FIG. 6) of the low beam pattern $A_2$ (see FIG. 6) formed by the low beam shield 100. A first side (e.g., a side connected to a third cut-off edge 142) of the second cut-off edge 132 may form a step with a second side (e.g., a side connected to the third cut-off edge 142) of the first cut-off edge 122. In particular, the first side of the second cut-off edge 132 may disposed lower than the second side of the first cut-off edge 122. Alternatively, the entire second cut-off edge 132 may be disposed lower than the entire first cut-off edge 122 that forms a step with the first cut-off edge 122.

As illustrated in FIG. 2, an upper surface 131 of the second front plate 130 having the second cut-off edge 132 may form a negative slope $\theta_1$ with respect to the upper surface of the back plate 110 and may further form a downwardly inclined plane. Referring to FIGS. 1 and 2, a rear end 133 of the upper surface 131 of the second front plate 130 may form a common plane with the upper surface of the back plate 110. The third front plate 140 may extend forward from a central portion of the front end of the back plate 110 and may connect the first front plate 120 and the second front plate 130. Referring to FIG. 1, an upper surface 141 of the third front plate 140 may connect the upper surface 121 of the first front plate 120 and the upper surface 131 of the second front plate 130.

Further, the third cut-off edge 142 may be formed at a front end of the third front plate 140. The third cut-off edge 142 may connect the first cut-off edge 122 and the second cut-off edge 132. To connect the first side of the second cut-off edge 132 and the second side of the first cut-off edge 122 which form a step therebetween, the third cut-off edge 142 may form an edge having an angle to a horizontal line and a vertical line. The third cut-off edge 142 may be disposed the first cut-off edge 122 and the second cut-off edge 132 and may form a central portion of the cut-off line C (see FIG. 5) of the low beam pattern $A_2$ (see FIG. 6) formed by the low beam shield 100.

Additionally, a rear end 143 of the upper surface 141 of the third front plate 140 may form a common (e.g., the same) plane with the upper surface of the back plate 110. Further, a front end of the upper surface 141 of the third front plate 140 at which the third cut-off edge 142 may form an edge having an angle to a horizontal line and a vertical line. Therefore, the upper surface 141 of the third front plate 140 may connect to the upper surface 121 of the first front plate 120 and the upper surface 131 of the second front plate 130 may have a plurality of slopes (e.g., different) slopes, thereby forming a twisted quadrilateral.

Figure 3:
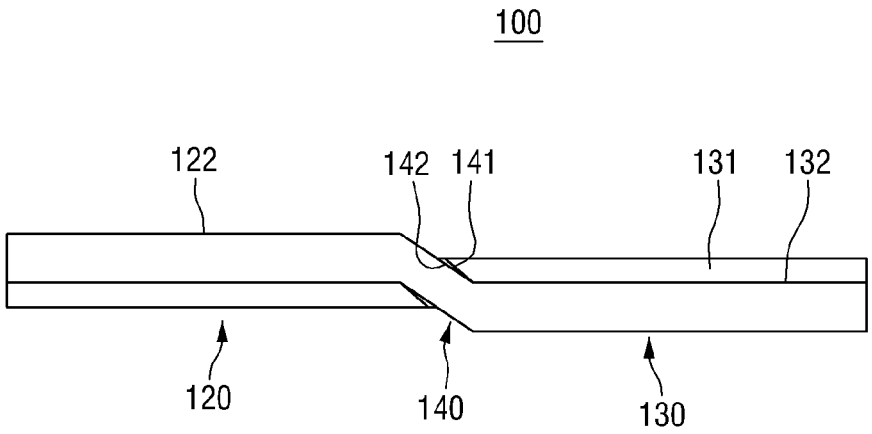
FIG. 3 is an exemplary front view of the low beam shield of FIG. 1 according to an exemplary embodiment of the present invention.

FIG. 3 is an exemplary front view of the low beam shield 100 of FIG. 1. Referring to FIG. 3, when the low beam shield 100 according to an exemplary embodiment is viewed from the front, since the first front plate 120 forms the positive slope $\theta_2$ with respect to the back plate 110, the upper surface 121 of the first front plate 120 may not be observed. Conversely, since the second front plate 130 forms the negative slope $\theta_1$ with respect to the back plate 110, the upper surface 131 of the second front plate 130 may be observed. Additionally, since the upper surface 141 of the third front plate 140 forms a twisted quadrilateral, part of the upper surface 141 of the third front plate 140 may be observed from the front.

Figure 4:
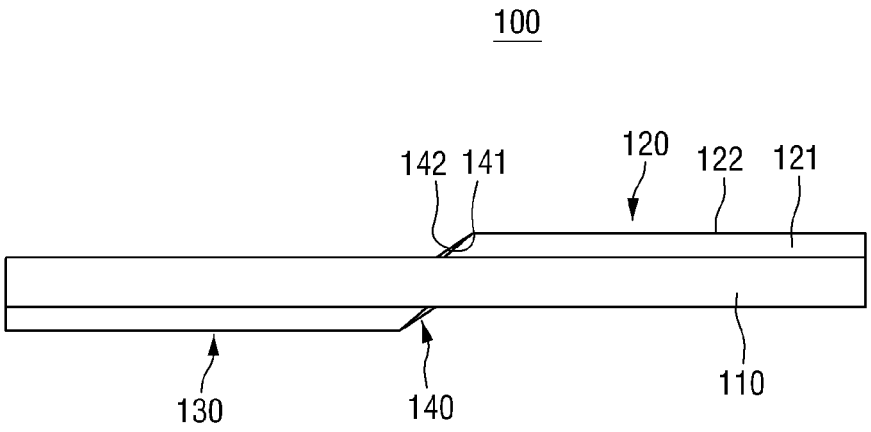
FIG. 4 is an exemplary rear view of the low beam shield of FIG. 1 according to an exemplary embodiment of the present invention.

FIG. 4 is an exemplary rear view of the low beam shield 100 of FIG. 1. Referring to FIG. 4, when the low beam shield 100 according to an exemplary embodiment of the present invention is seen from the back, the back plate 110 which forms the horizontal plane extending from the rear of the first front plate 120 to the rear of the second front plate 130 may be observed. Additionally, since the first front plate 120 forms the positive slope $\theta_2$ with respect to the back plate 110, the upper surface 121 of the first front plate 120 may be observed. Conversely, since the second front plate 130 forms the negative slope $\theta_1$ with respect to the back plate 110, the upper surface 131 of the second front plate 130 may not observed. Additionally, since the upper surface 141 of the third front plate 140 forms a twisted quadrilateral, part of the upper surface 141 of the third front plate 140 may be observed from the back.

Figure 5:
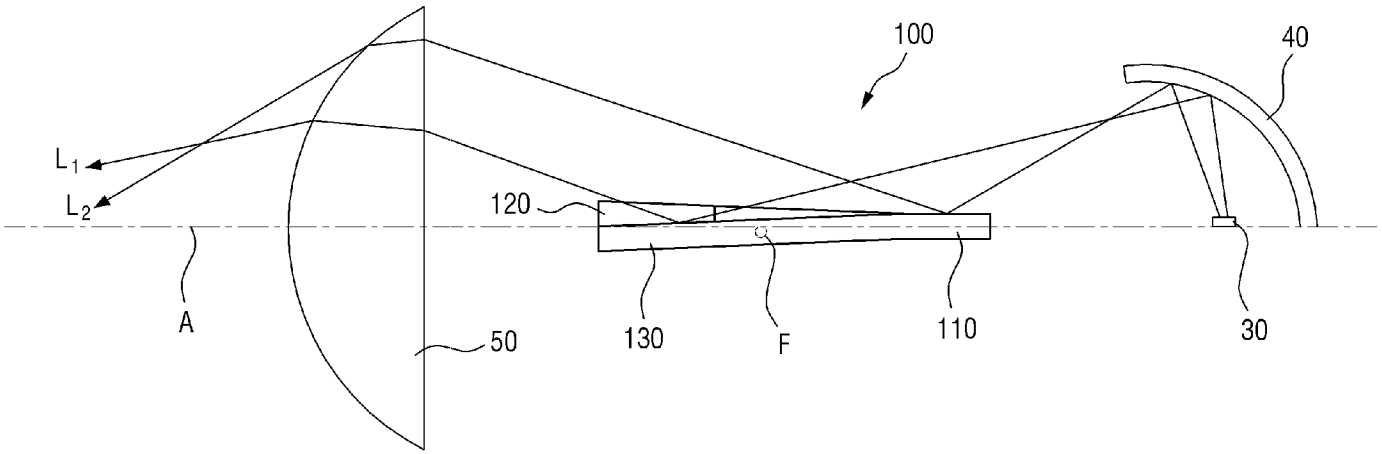
FIG. 5 is an exemplary schematic diagram that illustrates the path of light reflected by the low beam shield of FIG. 1 according to an exemplary embodiment of the present invention.
Figure 6:
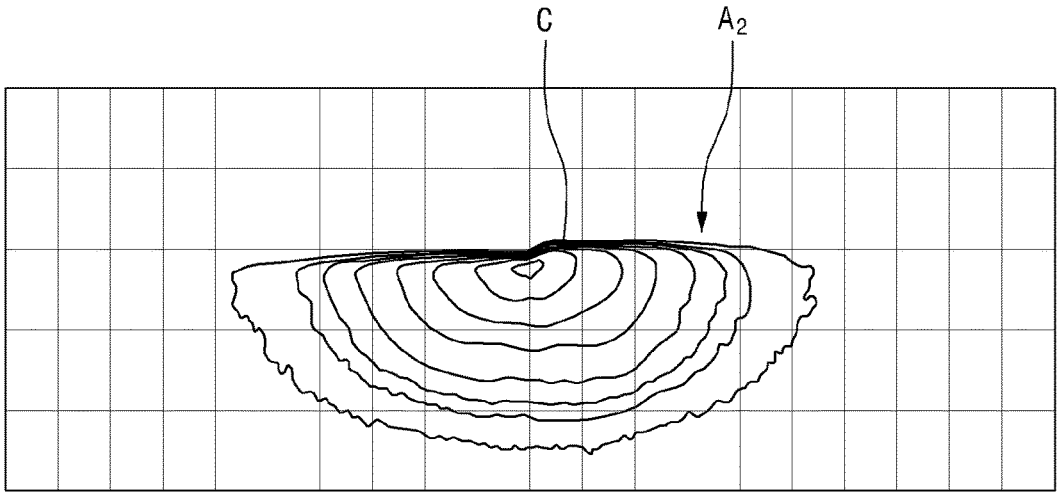
FIG. 6 is an exemplary illustration of a low beam pattern formed by a low beam irradiated onto a screen by the low beam shield according to an exemplary embodiment of the present invention.

FIG. 5 is an exemplary schematic diagram illustrating the path of light reflected by the low beam shield 100 of FIG. 1. FIG. 6 illustrates a low beam pattern $A_2$ that may be formed by a low beam irradiated onto a screen by the low beam shield 100 according to an exemplary embodiment of the present invention. The upper surface of the back plate 110 and the upper surfaces 121, 131 and 141 of the first front plate 120, the second front plate 130 and the third front plate 140 may be coated with a reflective material such as aluminum or chrome. Therefore, as illustrated in FIG. 5, light emitted from a light source 30 and reflected by a reflector 40 to enter an upper surface of the low beam shield 100 may be reflected by the upper surface of the back plate 110 and the upper surfaces 121, 131 and 141 of the first front plate 120, the second front plate 130 and the third front plate 140. Accordingly, the reflected light may enter an upper portion of a lens 50. Light L1 and L2 reflected by the upper surface of the back plate 110 and the upper surfaces 121, 131 and 141 of the first front plate 120, the second front plate 130 and the third front plate 140 may be refracted by the lens 50 to reinforce the luminous intensity of the low beam pattern $A_2$.

Referring to FIG. 5, the light L2 reflected off the upper surface of the back plate 110 may be refracted downward at a greater angle by the lens 50 than the light L1 reflected off the upper surfaces 121, 131 and 141 of the first front plate 120, the second front plate 130 and the third front plate 140. Accordingly, the light L2 may reinforce a lower pattern of the low beam pattern $A_2$. When a low beam is irradiated onto the screen located 25 meters ahead by the low beam shield 100 according to an exemplary embodiment of the present invention, the low beam pattern $A_2$ as illustrated in FIG. 6 may be formed. In particular, the closed loops illustrated in FIG. 6 may include lines that connect points having approximately the same luminous intensity in the low beam pattern $A_2$ formed on the screen. The luminous intensity may gradually increase from the exterior toward the interior.

Figure 18:
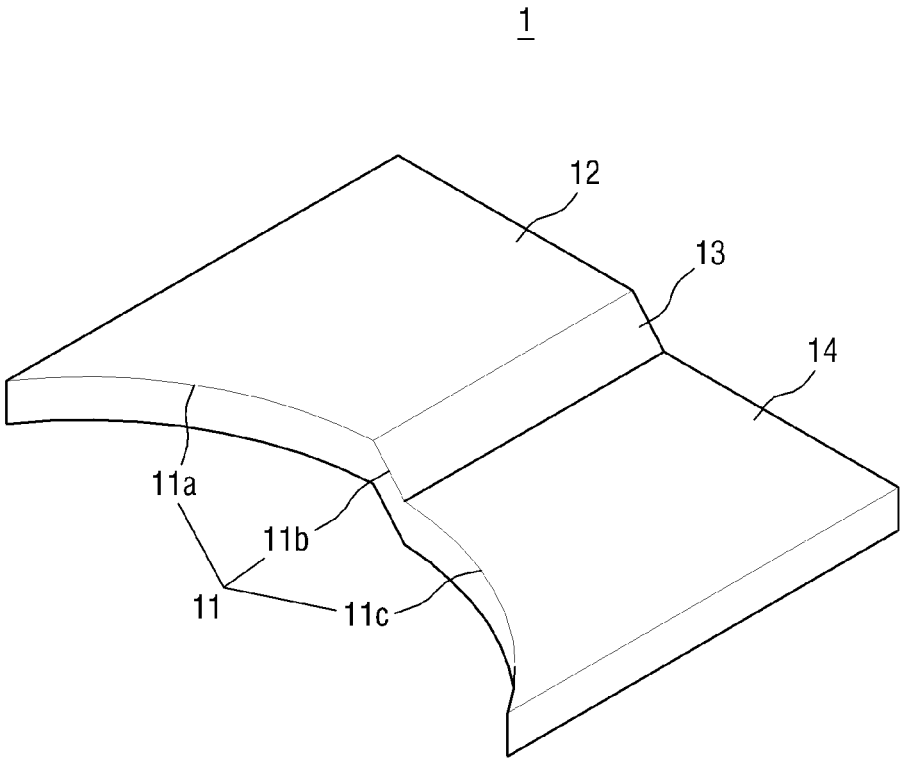
FIG. 18 Related Art
FIG. 18 is an exemplary perspective view of a conventional shield according to the related art.

Referring to FIG. 6, the low beam pattern $A_2$ according to an exemplary embodiment may form the cut-off line C that corresponds to the first cut-off edge 122, the second cut-off edge 132 and the third cut-off edge 142. Like the conventional low beam pattern $A_1$ of FIG. 19, the low beam pattern $A_2$ according to an exemplary embodiment may form the cut-off line C having a right side disposed higher than a left side. However, a region of the low beam pattern $A_2$ which corresponds to the B region of the conventional low beam pattern $A_1$ may not be distorted. For example, the upper surface of the back plate 110 in the low beam shield 100 according to an exemplary embodiment may form a horizontal plane, unlike in the conventional shield 1 (see FIG. 18). Therefore, the lower pattern of the low beam pattern $A_2$ may have a substantially uniform distribution.

Additionally, a step difference between the upper surfaces 121 and 131 of the first front plate 120 and the second front plate 130 may be reduced toward the rear ends 123 and 133. Therefore, light reflected by the upper surface of the back plate 110 and the upper surfaces 121, 131 and 141 of the first front plate 120, the second front plate 130 and the third front plate 140 may be irradiated to below the cut-off line C in substantially uniform distribution without being significantly distorted.

Figure 19:
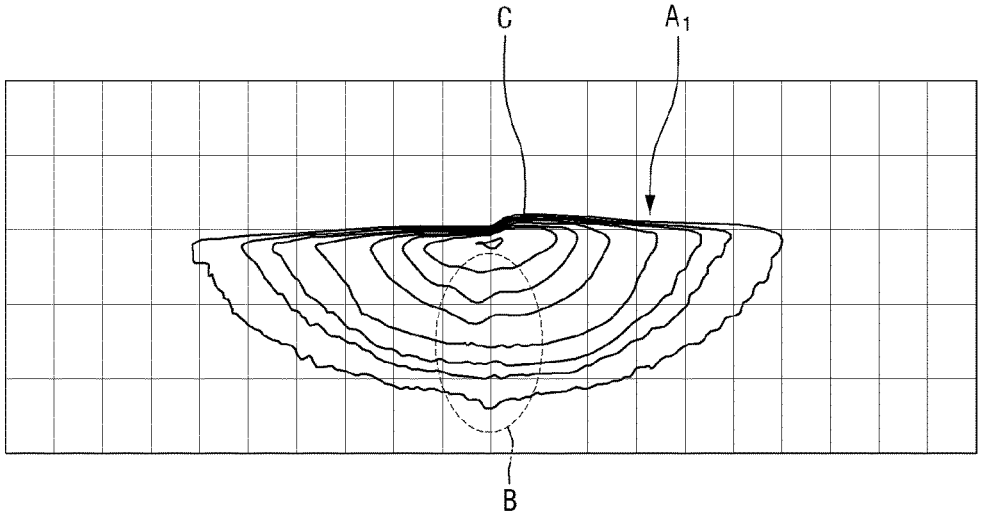
FIG. 19 Related Art
FIG. 19 is an exemplary illustration of a low beam pattern formed by a low beam irradiated by the conventional shield onto a screen according to the related art.

When light is irradiated to the ground in front of a vehicle in a beam pattern whose luminous intensity changes sharply as in the B region of FIG. 19, the light may have non-uniform intensity of illumination and luminance, and may cause visual fatigue to a driver. Conversely, the low beam pattern $A_2$ according to an exemplary embodiment may have an approximately uniform distribution of luminous intensity without a region having a sharp change in luminous intensity. Therefore, the visual fatigue to a driver due to a low beam may be reduced. Other exemplary embodiments of the present invention will hereinafter be described. For ease of description, elements similar to those of the first embodiment are indicated by like reference numerals, and thus their description will be omitted.

Figure 7:
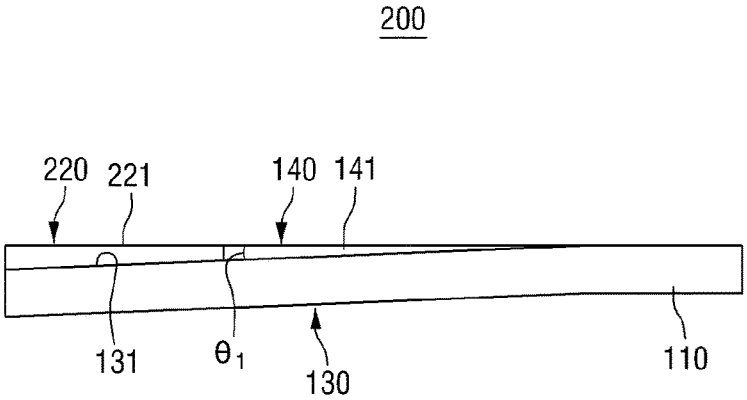
FIG. 7 is an exemplary side view of a low beam shield according to a second exemplary embodiment of the present invention.

FIG. 7 is an exemplary side view of a low beam shield 200 according to an exemplary embodiment of the present invention. Referring to FIG. 7, the low beam shield 200 may include a back plate 110, a first front plate 220, a second front plate 130, and a third front plate 140. The back plate 110, the second front plate 130 and the third front plate 140 of the low beam shield 200 may be similar to those of the low beam shield 100 according to the embodiment described above, and thus a detailed description thereof is omitted. In the low beam shield 100 according to an embodiment of the present invention, the upper surface 121 of the first front plate 120 may form the positive slope $\theta_2$ with respect to the upper surface of the back plate 110. Alternatively, in the low beam shield 200 according to the second embodiment of the present invention, an upper surface 221 of the first front plate 220 may be disposed in a common plane with an upper surface of the back plate 110.

A low beam pattern formed according to the above shape of the low beam shield 200 may be different from the low beam pattern $A_2$ illustrated in FIG. 6. However, the low beam pattern may be, similar to the low beam pattern $A_2$ illustrated in FIG. 6. Additionally, as shown in the low beam shield 100 according to the first embodiment of the present invention, in the low beam shield 200 according to the second exemplary embodiment, the upper surface of the back plate 110 may form a horizontal plane, and a step difference between upper surfaces 221 and 131 of the first front plate 220 and the second front plate 130 may be reduced toward rear ends of the upper surfaces 221 and 131. Therefore, a region having significant variation in luminous intensity as in the B region of the conventional low beam pattern $A_1$ (see FIG. 19) does not exist.

Figure 8:
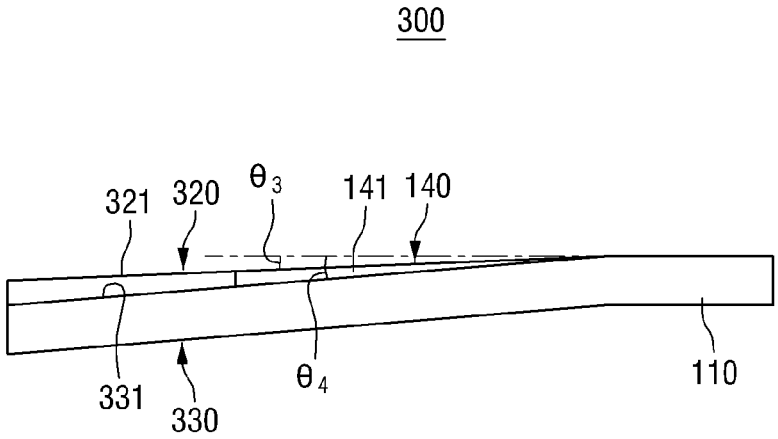
FIG. 8 is an exemplary side view of a low beam shield according to a third exemplary embodiment of the present invention.

FIG. 8 is an exemplary side view of a low beam shield 300 according to a third exemplary embodiment. Referring to FIG. 8, the low beam shield 300 may include a back plate 110, a first front plate 320, a second front plate 330, and a third front plate 140. The back plate 110 and the third front plate 140 of the low beam shield 300 may be similar to those of the low beam shield 100 according to the first embodiment of the present invention described above, and thus a detailed description thereof is omitted.

In the low beam shield 100 according to the first embodiment of the present invention, the upper surface 121 of the first front plate 120 forms the positive slope $\theta_2$ with respect to the upper surface of the back plate 110, and the upper surface 131 of the second front plate 130 forms the negative slope $\theta_1$ with respect to the upper surface of the back plate 110. Alternatively, the low beam shield 300 according to the third exemplary embodiment of the present invention, both an upper surface 321 of the first front plate 320 and an upper surface 331 of the second front plate 330 may form negative slopes $\theta_3$ and $\theta_4$ with respect to an upper surface of the back plate 110.

However, the negative slopes $\theta_3$ and $\theta_4$ of the upper surface 321 of the first front plate 320 and the upper surface 331 of the second front plate 330 may vary. In other words, an absolute value of the slope $\theta_3$ of the upper surface 321 of the first front plate 320 may be less than an absolute value of the slope $\theta_4$ of the upper surface 331 of the second front plate 330 such that the upper surface 321 of the first front plate 320 may be disposed higher than the upper surface 331 of the second front plate 330. For example, a cut-off edge having a similar shape to that of the first embodiment may be formed.

A low beam pattern formed according to the above shape of the low beam shield 300 may differ from the low beam pattern $A_2$ illustrated in FIG. 6. However, the low beam pattern may be, similar to the low beam pattern $A_2$ illustrated in FIG. 6. In addition, as shown in the low beam shield 100 according to the first embodiment of the present invention, the low beam shield 300 according to the third embodiment of the present invention, the upper surface of the back plate 110 may form a horizontal plane. Further a step difference between the upper surfaces 321 and 331 of the first front plate 320 and the second front plate 330 may be reduced toward rear ends of the upper surfaces 321 and 331. Therefore, a region having a significant variation in luminous intensity as in the B region of the conventional low beam pattern $A_1$ (see FIG. 19) does not exist.

Figure 9:
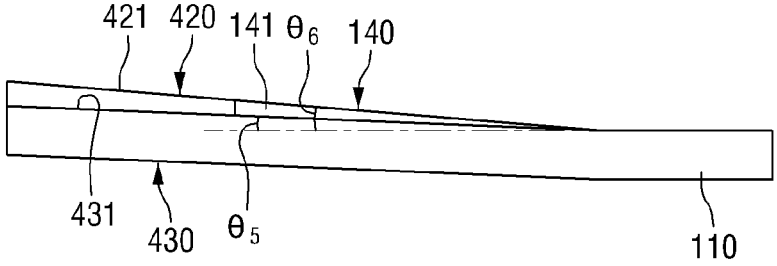
FIG. 9 is an exemplary side view of a low beam shield according to a fourth exemplary embodiment of the present invention.

FIG. 9 is an exemplary side view of a low beam shield 400 according to a fourth exemplary embodiment of the present invention. Referring to FIG. 9, the low beam shield 400 may include a back plate 110, a first front plate 420, a second front plate 430, and a third front plate 140. The back plate 110 and the third front plate 140 of the low beam shield 400 may be similar to those of the low beam shield 100 according to the first exemplary embodiment described above, and thus a detailed description thereof is omitted. In the low beam shield 100 according to the first exemplary embodiment of the present invention, the upper surface 121 of the first front plate 120 may form the positive slope $\theta_2$ with respect to the upper surface of the back plate 110. The upper surface 131 of the second front plate 130 may form the negative slope $\theta_1$ with respect to the upper surface of the back plate 110. Conversely, in the low beam shield 400 according to the fourth exemplar embodiment, both an upper surface 421 of the first front plate 420 and an upper surface 431 of the second front plate 430 may form positive slopes $\theta_5$ and $\theta_6$ with respect to an upper surface of the back plate 110.

However, the positive slopes $\theta_5$ and $\theta_6$ of the upper surface 421 of the first front plate 420 and the upper surface 431 of the second front plate 430 may vary. For example, an absolute value of the slope $\theta_6$ of the upper surface 421 of the first front plate 420 may be greater than an absolute value of the slope $\theta_5$ of the upper surface 431 of the second front plate 430. Further, the upper surface 421 of the first front plate 420 may be disposed higher than the upper surface 431 of the second front plate 430. For example, a cut-off edge having a similar shape to that of the first embodiment may be formed.

A low beam pattern may be formed based on the above shape of the low beam shield 400 that may be somewhat different from the low beam pattern $A_2$ illustrated in FIG. 6. However, the low beam pattern may be, substantially similar to the low beam pattern $A_2$ illustrated in FIG. 6. Additionally, as shown in the low beam shield 100 according to the first exemplary embodiment, the low beam shield 400 according to the fourth exemplary embodiment, the upper surface of the back plate 110 may form a horizontal plane. Further a step difference between the upper surfaces 421 and 431 of the first front plate 420 and the second front plate 430 may be reduced toward rear ends of the upper surfaces 421 and 431. Therefore, a region having significant variation in luminous intensity as in the B region of the conventional low beam pattern $A_1$ (see FIG. 19) does not exist.

Figure 10:
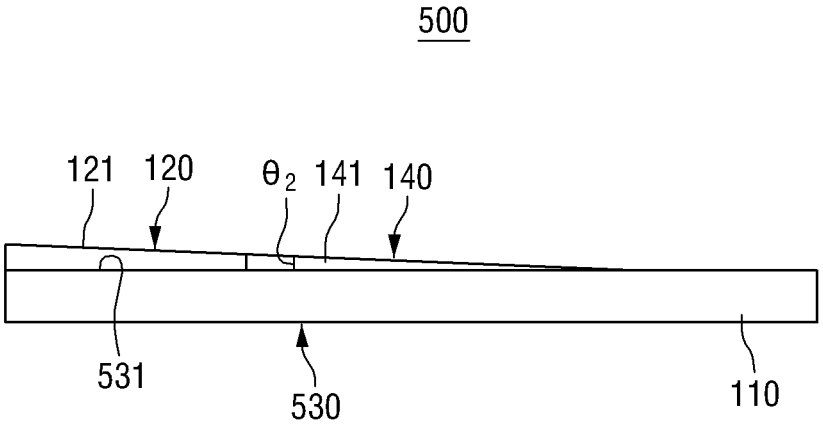
FIG. 10 is an exemplary side view of a low beam shield according to a fifth exemplary embodiment of the present invention.

FIG. 10 is an exemplary side view of a low beam shield 500 according to a fifth exemplary embodiment. Referring to FIG. 10, the low beam shield 500 may include a back plate 110, a first front plate 120, a second front plate 530, and a third front plate 140. The back plate 110, the first front plate 120 and the third front plate 140 of the low beam shield 500 may be similar to those of the low beam shield 100 according to the first exemplary embodiment described above, and thus a detailed description thereof is omitted. In the low beam shield 100 according to the first embodiment of the present invention, the upper surface 131 of the second front plate 130 forms the negative slope $\theta_1$ with respect to the upper surface of the back plate 110. Conversely, in the low beam shield 500 according to the fifth exemplary embodiment of the present invention, an upper surface 531 of the second front plate 530 may be in a common plane with an upper surface of the back plate 110.

A low beam pattern formed according to the above shape of the low beam shield 500 may be different from the low beam pattern $A_2$ illustrated in FIG. 6. However, the low beam pattern may be, similar to the low beam pattern $A_2$ illustrated in FIG. 6. Additionally, as in the low beam shield 100 according to the first exemplary embodiment, in the low beam shield 500 according to the fifth exemplary embodiment of the present invention, the upper surface of the back plate 110 may form a horizontal plane, and a step difference between upper surfaces 121 and 531 of the first front plate 120. Further, the second front plate 530 may be reduced toward rear ends of the upper surfaces 121 and 531. Therefore, a region having a significant variation in luminous intensity as in the B region of the conventional low beam pattern $A_1$ (see FIG. 19) does not exist.

Figure 11:
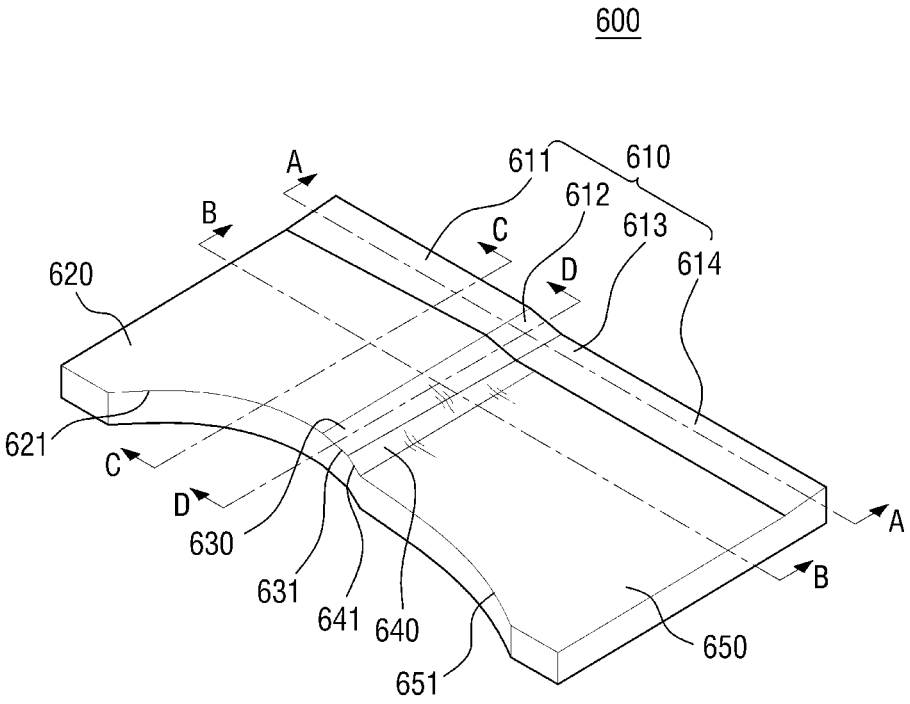
FIG. 11 is an exemplary perspective view of a low beam shield according to a sixth exemplary embodiment of the present invention.

FIG. 11 is an exemplary perspective view of a low beam shield 600 according to a sixth exemplary embodiment of the present invention. Referring to FIG. 11, the low beam shield 600 according to the sixth exemplary embodiment of the present invention may include a back plate 610, a first front plate 620, a second front plate 650, a third front plate 630, and a fourth front plate 640. Upper surfaces of the back plate 610, the first front plate 620, the second front plate 650, the third front plate 630 and the fourth front plate 640 may be coated with a reflective material such as aluminum or chrome. For example light incident upon any one of the back plate 610, the first front plate 620, the second front plate 650, the third front plate 630 and the fourth front plate 640 may be reflected. As illustrated in FIG. 11, the back plate 610 may form the base of the first front plate 620, the second front plate 650, the third front plate 630 and the fourth front plate 640. The back plate 610 my include a first portion 611 coupled to the upper surface of the first front plate 620, a second portion 614 coupled to the upper surface of the second front plate 650, a third portion 612 coupled to the upper surface of the third front plate 630, and a fourth portion 613 coupled to the upper surface of the fourth front plate 640.

Figure 12:
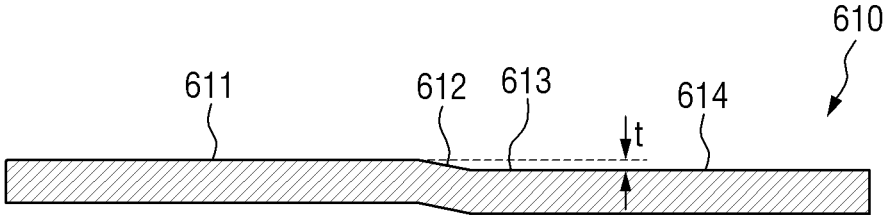
FIG. 12 is an exemplary cross-sectional view taken along the line A-A of FIG. 11 according to an exemplary embodiment of the present invention.

FIG. 12 is an exemplary cross-sectional view taken along the line A-A of FIG. 11. Referring to FIGS. 11 and 12, the second portion 614 and the fourth portion 613 may form a common plane. The plane formed by the second portion 614 and the fourth portion 613 may be a horizontal plane. The first portion 611 may form a step t with the second portion 614 and the fourth portion 613 and may form a parallel plane. Additionally, the third portion 612 may connect the first portion 611 and the fourth portion 613 which form a step therebetween and slopes downward toward a second side of the back plate 610.

Figure 13:
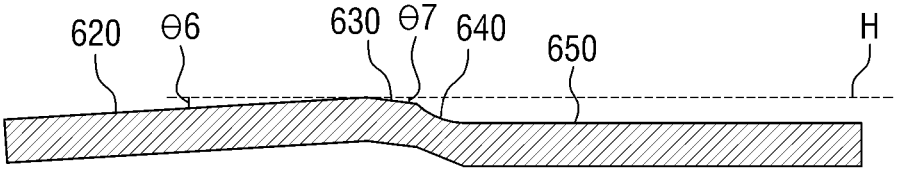
FIG. 13 is an exemplary cross-sectional view taken along the line B-B of FIG. 11 according to an exemplary embodiment of the present invention.
Figure 14:
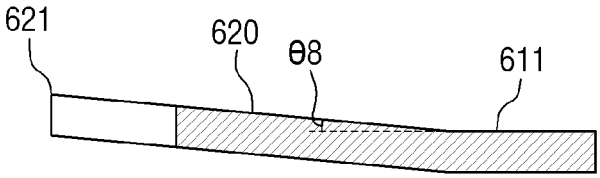
FIG. 14 is an exemplary cross-sectional view taken along the line C-C of FIG. 11 according to an exemplary embodiment of the present invention.
Figure 15:
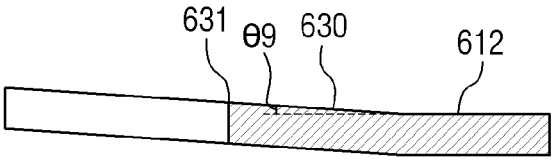
FIG. 15 is an exemplary cross-sectional view taken along the line D-D of FIG. 11 according to an exemplary embodiment of the present invention.

The first front plate 620, the second front plate 650, the third front plate 630 and the fourth front plate 640 will be described with reference to FIGS. 13 through 15, together with FIG. 11. FIG. 13 is an exemplary cross-sectional view taken along the line B-B of FIG. 11. FIG. 14 is an exemplary cross-sectional view taken along the line C-C of FIG. 11. FIG. 15 is an exemplary cross-sectional view taken along the line D-D of FIG. 11. Referring to FIG. 11, the first front plate 620 may extend forward from a first side of a front end of the back plate 610. A first cut-off edge 621 which is convex rearward may be formed at a front end of the first front plate 620. The first cut-off edge 621 may be a curve displaced along a rear focal plane of a lens (not illustrated) disposed in front of the low beam shield 600.

The first cut-off edge 621 may form a first or second side of a cut-off line of a low beam pattern formed by the low beam shield 600. The upper surface of the first front plate 620 may include the first cut-off edge 621 that slopes downward toward a first side of the back plate 610 as illustrated in FIG. 13. An angle θ6 may be formed by the upper surface of the first front plate 620 and a horizontal line H may be parallel to a horizontal plane may be selected in a range of about 0.5 to 2 degrees. The effect of the angle θ6 formed by the upper surface of the first front plate 620 to the horizontal line H will be described later. The upper surface of the first front plate 620 may slopes upward in a forward direction. Therefore, referring to FIG. 14, in the cross-section taken along the line C-C of FIG. 11, the upper surface of the first front plate 620 may slope at a positive angle θ8 with respect to the first portion 611 of the back plate 610 and may slope downward in a direction toward the first portion 611.

The second front plate 650 may extend forward from a second side of the front end of the back plate 610. A second cut-off edge 651 which is convex rearward may be formed at a front end of the second front plate 650. The second cut-off edge 651 may be a curve shape displaced along the rear focal plane of the lens (not illustrated) disposed in front of the low beam shield 600. However, a first side (a side connected to a fourth cut-off edge 641) of the second cut-off edge 651 may form a step with a second side (e.g., a side connected to a third cut-off edge 631) of the first cut-off edge 621. For example, the first side of the second cut-off edge 651 may be disposed lower than the second side of the first cut-off edge 621. Alternatively, the entire second cut-off edge 651 may be disposed lower than the entire first cut-off edge 621 that forms a step with the first cut-off edge 621. The second cut-off edge 651 may form the second or first side of the cut-off line of the low beam pattern formed by the low beam shield 600.

As illustrated in FIG. 13, the upper surface of the second front plate 650 having the second cut-off edge 651 may form a plane parallel to the horizontal line H parallel to the horizontal plane. The upper surface of the second front plate 650 may form as a horizontal plane in a common plane with the second portion 614. The third front plate 630 and the fourth front plate 640 may extend forward from a central portion of the front end of the back plate 610 such that third front plate 630 and the fourth front plate 640 are disposed between the first front plate 620 and the second front plate 650. The third front plate 630 may be coupled to the first front plate 620, and the fourth front plate 640 may be coupled to the second front plate 650. The third cut-off edge 631 may be continuous from the first cut-off edge 621 formed at a front end of the third front plate 630. A second side (a side connected to the fourth cut-off edge 641) of the third cut-off edge 631 may form a step with the first side (e.g., a side connected to the fourth cut-off edge 641) of the second cut-off edge 651. The third cut-off edge 631 may form a portion of the cut-off line of the low beam pattern formed by the low beam shield 600.

As illustrated in FIG. 13, the upper surface of the third front plate 630 having the third cut-off edge 631 may slope downward at an angle of θ7 with respect to the horizontal line H toward the second side of the back plate 610. The angle θ7 may be formed by the upper surface of the third front plate 630 and the horizontal line H parallel to the horizontal plane may be selected in a range of about 0.5 to 2 degrees. The angle θ7 formed by the upper surface of the third front plate 630 and the horizontal line H may be parallel to the horizontal plane may preferably be approximately 2 degrees. The upper surface of the third front plate 630 may slope upward in the forward direction. Therefore, referring to FIG. 15, in the exemplary cross-section taken along the line D-D of FIG. 11, the upper surface of the third front plate 630 may slope at a positive angle θ9 with respect to the third portion 612 of the back plate 610 and may slope downward toward the third portion 612.

The fourth cut-off edge 641 which connects the third cut-off edge 631 and the second cut-off edge 651 may be formed at a front end of the fourth front plate 640. To connect the first side of the second cut-off edge 651 and the second side of the third cut-off edge 631 which form a step there between, the fourth cut-off edge 641 may form an edge having an angle with respect to a horizontal line and a vertical line. The fourth cut-off edge 641 between the second cut-off edge 651 and the third cut-off edge 631 may form a central portion of the cut-off line of the low beam pattern formed by the low beam shield 600.

A rear end of the upper surface of the fourth front plate 640 may form a common plane with the fourth portion 613. However, since a front end of the upper surface of the fourth front plate 640 having the fourth cut-off edge 641 may form an edge having an angle with respect to the horizontal line and the vertical line, the upper surface of the fourth front plate 640 may form a quadrilateral having a distorted curved surface that slopes more steeply toward the front. As a result, the step t formed between the second portion 614 and the first portion 611 of the back plate 610 may be less than a step formed between the second side of the first cut-off edge 621 and the first side of the second cut-off edge 651. Accordingly, the cut-off line of the low beam pattern may have a right side disposed higher than a left side thereof. This ensures a wider irradiation range on the right side ahead of a vehicle than on the left side and also reduces a step difference between the first, second, third and fourth portions 611, 612, 613 and 614 of the back plate 610. Therefore, the probability that light reflected by the first, second, third and fourth portions 611, 612, 613 and 614 of the back plate 610 will form a region (e.g., in particular, a lower region of the low beam pattern) having a non-uniform luminous intensity in the low beam pattern may be reduced.

Figure 16:
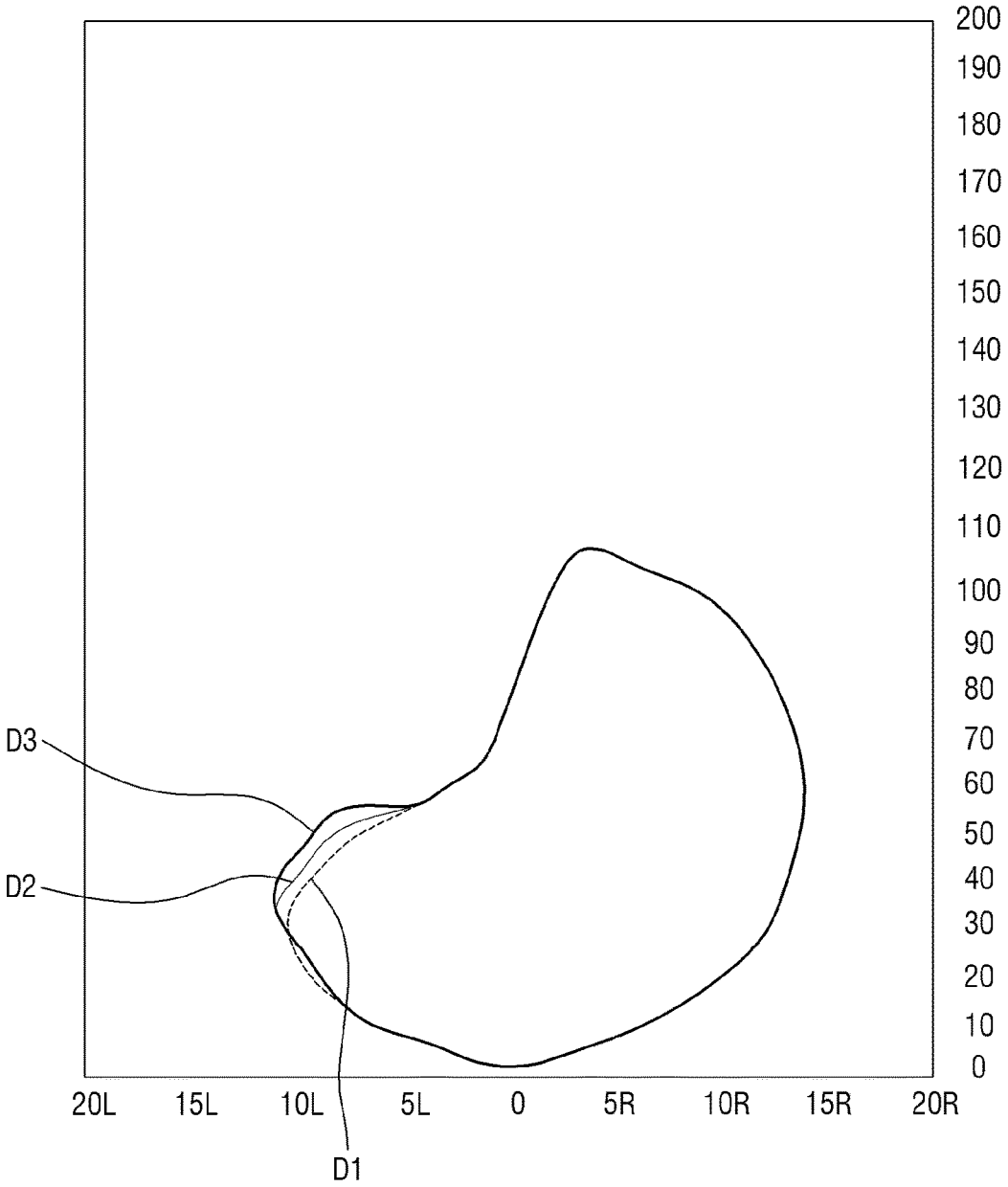
FIG. 16 is an exemplary graph illustrating the change in the low beam irradiation range with respect to the downward angle of a first front plate of the low beam shield according to the according to a sixth exemplary embodiment of the present invention.

FIG. 16 is an exemplary graph illustrating the change in the low beam irradiation range with respect to the downward angle of the first front plate 620 of the low beam shield 600 according to the sixth exemplary embodiment of the present invention. Referring to FIG. 16, a variation in the angle θ6 formed by the upper surface of the first front plate 620 and the horizontal line H may alter the irradiation regions of low beam patterns D1 through D3. D1 represents a low beam pattern created when the angle θ6 formed by the upper surface of the first front plate 620 and the horizontal line H may be about 0 degrees. D2 represents a low beam pattern created when the angle θ6 formed by the upper surface of the first front plate 620 and the horizontal line H may be about 1 degree. Further, D3 represents a low beam pattern created when the angle θ6 formed by the upper surface of the first front plate 620 and the horizontal line H may be about 2 degrees.

As illustrated in FIG. 16, when the angle θ6 formed by the upper surface of the first front plate 620 and the horizontal line H is adjusted within the range of about 0 to 2 degrees, a left irradiation region of a low beam pattern may be enlarged. As illustrated in FIG. 16, in the exemplary embodiment, since light illuminating the left side ahead of a vehicle may extend beyond a cut-off line in the case of the low beam pattern D3, the angle θ6 formed by the upper surface of the first front plate 620 and the horizontal line H should preferably be about 1 degree. Therefore, the upper surface of the first front plate 620 of the low beam shield 600 may be formed to slightly slope downward toward the first side of the back plate 610, thereby improving the visibility of a low beam pattern on the left side ahead of a vehicle.

Figure 17:
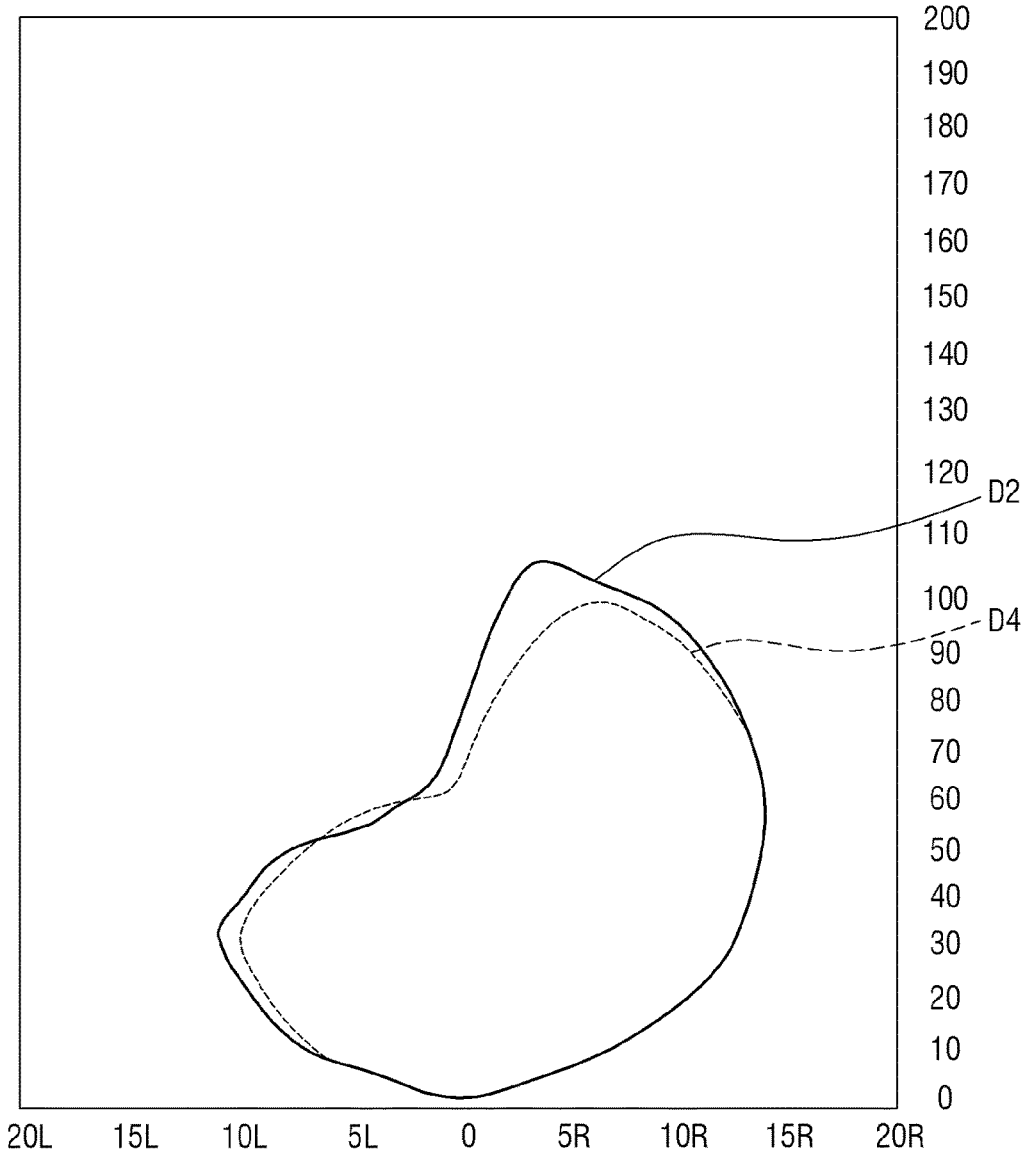
FIG. 17 is an exemplary graph comparing a low beam pattern formed by the low beam shield according to the sixth exemplary embodiment of the present invention with a conventional low beam pattern.

FIG. 17 is an exemplary graph comparing a low beam pattern D2 formed by the low beam shield 600 according to the sixth exemplary embodiment with a conventional low beam pattern D4. Since the low beam pattern D2 is identical to the low beam pattern D2 of FIG. 16, the same reference numeral is used. The conventional low beam pattern D4 is indicated by a dotted line. Referring to FIG. 17, the low beam pattern D2 formed by the low beam shield 600 according to the current embodiment has an improved light irradiation range at a long distance, in a central portion, and on the left side ahead of a vehicle than the conventional low beam pattern D4. The improvement in the light irradiation range on the left side ahead of a vehicle is as described above with reference to FIG. 16, and the improvement in the light irradiation range at a long distance and in the central portion results from shape characteristics of the third front plate 630 and the fourth front plate 640 of the low beam shield 600 according to the sixth exemplary embodiment.

As described above, the upper surface of the third front plate 630 may slope downward at the angle of θ7 with respect to the horizontal line H in the direction toward the second side of the back plate 610 as illustrated in FIG. 13 and may slope upward in the forward direction as illustrated in FIG. 14. Such characteristics of the third front plate 630 may increase light travelling to the central portion of the low beam pattern D2. Accordingly, the light irradiation distance and range of the central portion of the low beam pattern D2 as illustrated in FIG. 17 may be improved. In addition, as described above, the upper surface of the fourth front plate 640 may form a distorted curved surface that slopes more steeply toward the front. Such characteristics of the fourth front plate 640 may increase light travelling to an upper left side of a cut-off line, and may increase a maximum irritation distance of the low beam pattern D2 as illustrated in FIG. 17.

Embodiments of the present invention provide at least one of the following advantages. A low beam pattern having a more uniform light distribution may be formed. Therefore, the visual fatigue of a driver due to a low beam irradiated to ahead of a vehicle may be reduced. However, the effects of the present invention are not restricted to the one set forth herein. The above and other effects of the present invention will become more apparent to one of daily skill in the art to which the present invention pertains by referencing the claims.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A low beam shield for headlamps installed in a headlamp of a vehicle and forms a low beam pattern irradiated ahead of the vehicle, the low beam shield comprising:

a back plate that forms a horizontal plane;

a first front plate that extends from a first side of a front end of the back plate and forms a first cut-off edge;

a second front plate that extends from a second side of the front end of the back plate and forms a second cut-off edge, wherein an upper surface of the first front plate having the first cut-off edge has a different slope from an upper surface of the second front plate having the second cut-off edge; and a third front plate that extends from a central portion of the front end of the back plate to connect the first front plate and the second front plate and forms a third cut-off edge that connects the first cut-off edge and the second cut-off edge, wherein an upper surface of the third front plate is configured to connect the upper surface of the first front plate and the upper surface of the second front plate having a plurality of slopes, and wherein the upper surface of the third front plate is coupled to the upper surface of the first front plate and the upper surface of the second front plate has a plurality of slopes to form a twisted quadrilateral.

2. The low beam shield of claim 1, wherein the upper surface of the first front plate has a positive slope with respect to the back plate, and the upper surface of the second front plate has a negative slope with respect to the back plate.

3. The low beam shield of claim 1, wherein a rear end of the upper surface of the third front plate which contacts the back plate forms the same plane with the back plate.

4. The low shield lamp of claim 1, wherein an upper surface of the back plate and the upper surfaces of the first front plate, the second front plate and the third front plate are reflective surfaces.

5. A low beam shield for headlamps disposed within a headlamp of a vehicle and forms a low beam pattern irradiated ahead of the vehicle, the low beam shield comprising:

a back plate;

a first front plate that extends from a first side of a front end of the back plate and forms a first cut-off edge; and a second front plate that extends from a second side of the front end of the back plate and forms a second cut-off edge, wherein an upper surface of the first front plate having the first cut-off edge slopes downward in a direction toward a first side of the back plate, wherein a tilting direction of the first front plate is restricted between an angle formed by the upper surface of the first front plate and a line perpendicular to a traveling direction of a beam and parallel to a horizontal plane, and the angle is selected in a range of 0.5 to 2 degrees, and wherein the upper surface of the first front plat has a first slope going from the back plate toward the first cut-off edge, an upper surface of the second front plate has a second slope going from the back plate toward the second cut-off edge, and the first slope and the second slope are different.

6. The low beam shield of claim 5, further comprising a third front plate that extends from a central portion of the front end of the back plate disposed between the first front plate and the second front plate and forms a third cut-off edge.

7. The low beam shield of claim 6, wherein an upper surface of the third front plate having the third cut-off edge slopes downward toward a second side of the back plate.

8. The low beam shield of claim 7, wherein the upper surface of the third front plate slopes downward toward the back plate.

9. The low beam shield of claim 6, wherein the upper surface of the third front plate is continuous from the upper surface of the first front plate, and the third cut-off edge is continuous from the first cut-off edge.

10. The low beam shield of claim 6, further comprising a fourth front plate which extends from the central portion of the front end of the back plate disposed between the third front plate and the second front plat and forms a fourth cut-off edge.

11. The low beam shield of claim 10, wherein an upper surface of the fourth front plate has a rear end coupled to the back plate and forms a horizontal plane and a front end that slopes downward toward the second side of the back plate.

12. The low beam shield of claim 10, wherein the upper surface of the fourth front plate comprises an asymmetric curved surface.

13. The low beam shield of claim 10, wherein the upper surface of the fourth front plate is continuous from an upper surface of the second front plate and the upper surface of the third front plate, and a fourth cut-off edge is continuous from the second cut-off edge and the third cut-off edge.

14. The low beam shield of claim 11, wherein the back plate comprises a first portion coupled to the upper surface of the first front plate, a second portion coupled to the upper surface of the second front plate, a third portion coupled to the upper surface of the third front plate, and a fourth portion coupled to the upper surface of the fourth front plate, wherein the second portion and the fourth portion lie in the same plane with the horizontal plane.

15. The low beam shield of claim 14, wherein the upper surface of the second front plate lies in the same plane with the horizontal plane.

16. The low beam shield of claim 15, wherein the first portion is disposed in a plane parallel to the horizontal plane, and the third portion connects the first portion and the fourth portion and slopes downward toward the second side of the back plate.

17. The low beam shield of claim 10, wherein an upper surface of the back plate and the upper surfaces of the first front plate, the second front plate, the third front plate and the fourth plate are formed as reflective surfaces.

* * * * *